United States Patent [19]

Nilssen

[11] Patent Number: 4,890,039

[45] Date of Patent: Dec. 26, 1989

[54] FLUORESCENT LAMP RESONANT BALLAST

[76] Inventor: Ole K. Nilssen, Caesar Dr., Barrington, Ill. 60010

[21] Appl. No.: 273,677

[22] Filed: Nov. 21, 1988

Related U.S. Application Data

[63] Continuation of Ser. No. 530,943, Sep. 12, 1983, abandoned.

[51] Int. Cl.[4] ..... H05B 37/00

[52] U.S. Cl. ..... 315/119; 315/244; 315/224; 315/306; 315/309

[58] Field of Search ..... 315/119, DIG. 7, 243, 315/244, 307, 308, 309, 311, 224, 209 R

[56] References Cited

U.S. PATENT DOCUMENTS

| | | | |
|---|---|---|---|
| 3,710,177 | 1/1973 | Ward | 315/106 |
| 4,370,600 | 1/1983 | Zansky | 315/209 R |
| 4,398,126 | 8/1983 | Zuchtriegel | 315/127 |
| 4,406,976 | 9/1983 | Wisbey et al. | 315/244 X |
| 4,461,980 | 7/1984 | Nilssen | 315/225 |

*Primary Examiner*—Howard W. Britton
*Assistant Examiner*—Mark R. Powell

[57] ABSTRACT

Subject invention relates to a fluorescent lamp ballast that is intended for safe and cost-effective use in lighting systems wherein the power to the various lighting fixtures is provided from a central source of relatively high frequency (Ex: 30 kHz) AC voltage. The ballast consists of a resonant series-circuit of an inductor and a capacitor—with the fluorescent lamp connected in parallel with the capacitor. Due to series-resonant action, if the lamp should happen to be non-connected or non-functional, and if proper precautions are not taken, the magnitude of the voltage developed across the capacitor may become so large as to cause damage to the circuit components and/or even to the source. To prevent such circuit damage, yet providing for a lamp starting voltage of suitably large magnitude and for an adequately long time, a Varistor voltage-limiting means is connected in parallel with the capacitor and a thermally actuated circuit breaker is connected in thermal contact with the Varistor. When actuated, the circuit breaker stops the series-resonant action. Under normal circumstances, when starting the fluorescent lamp, the magnitude of the voltage developed across the capacitor will be limited by the Varistor; which, during the brief period it takes for the lamp to ignite, will not become hot enough to cause the circuit breaker to actuate. If the lamp is non-connected or non-functional, however, the Varistor will provide voltage limitation for a longer time; and, after a few seconds, it will become hot enough to cause actuation of the circuit breaker. Once actuated, the circuit breaker remains actuated until power is removed from the ballast input.

24 Claims, 1 Drawing Sheet

FLUORESCENT LAMP RESONANT BALLAST

This application is a continuation of Ser. No. 530,943, filed 9-12-1983, now abandoned.

BACKGROUND OF THE INVENTION

1. Field of the Invention

The present invention relates to series-resonant ballasting circuits for gas discharge lamps, particularly for situations wherein power to the lamp and ballasting means is provided from a high frequency voltage source.

2. Related Patent Applications

The applicant of the instant patent application filed a related patent application entitled "High Frequency Lighting System" on Aug. 25, 1983 (Ser. No. 526,389).

3. Description of Prior Art

Series-resonant ballasting of fluorescent lamps has been described in several prior publications, two examples of which are: U.S. Pat. No. 3,710,177 to Richard Ward, and U.S. Pat. No. 4,370,600 to Zoltan Zansky.

A basic problem associated with series-resonant ballasting relates to the tendency by a series-resonant circuit to develop extremely high voltages whenever the circuit is inadequately loaded. In a series-resonant fluorescent lamp ballast, the main circuit loading would be the fluorescent lamp. However, prior to lamp ignition, the load represented by the lamp is very small; which results in the development of an extremely high voltage across the lamp just prior to ignition. In fact, this initial extremely high voltage will normally be too high for proper lamp starting.

However, a more important problem relates to the situation where the fluorescent lamp is disconnected from the circuit or otherwise ceases to provide adequate circuit loading. In this case, in the absence of circuit protection means, the circuit voltages developed as a result of so-called Q-multiplication can easily reach levels high enough to cause destruction of the circuit or of the power source.

A partial solution to this problem has been provided by Ward in that he has arranged for the lamp cathodes to be connected in series with one of the reactive elements of the series-resonant circuit; which implies that, if the lamp is removed from its socket, the series-resonant circuit is broken, and the resonant effect ceases. However, this partial solution does not provide protection against the very common end-of-life lamp failure mode: where the lamp remains connected in the circuit, but simply fails to ignite.

A more complete but still partial solution to this problem has been provided by Zansky. He describes an inverter-ballast circuit having a means to limit the maximum voltage that can develop across the components of the series-resonant circuit. However, in Zansky's circuit, if the fluorescent lamp is removed, the voltage limiting action is apt to give rise to a significant continuous power loss; which would be due to the very high level of continuously circulating energy within the inverter-ballast circuit caused by the voltage-limiting action. Moreover, the components the in inverter-ballast circuit must be sized such as to be able to handle on a continuous basis this high level of circulating energy; which implies more costly components than otherwise would be necessary.

Also, it is noted that in Zansky's inverter-ballast circuit, the voltage limiting of the ballasting series-resonant circuit is accomplished with the help of the inverter itself and its DC power supply; which in most realistic circumstances implies a need for relatively close proximity between the inverter-part and the series-resonant ballasting part of the inverter-ballast combination.

Thus, Zansky's partial solution does not apply to situations where the inverter is located a substantial distance away from the series-resonant ballasting means, such as in situations where a single central inverter feeds high-frequency power to a number of lighting fixtures located at differenct spaced-apart places—as in a typical commercial suspended ceiling system.

SUMMARY OF THE INVENTION

Objects of the Invention

A first object of the present invention is that of providing a cost-effective ballasting means for gas discharge lamps.

A second object is that of providing a series-resonant fluorescent lamp ballast adapted to be powered from the relatively high frequency voltage output of an inverter, yet being independent of the inverter except for its supply of power.

A third object is that of providing a series-resonant fluorescent lamp ballast adapted to be powered from a voltage source of relatively high frequency and operable to be safely and efficiently used at locations remote from said voltage source.

These as well as other objects, features and advantages of the present invention will become apparent from the following description and claims.

Brief Description

Subject invention relates to a fluorescent lamp ballast intended for safe and cost-effective use in lighting systems wherein the power to various remote lighting fixtures is provided from a central source of relatively high frequency (Ex: 30 kHz) AC voltage.

The ballast consists of a resonant series-circuit of an inductor and a capacitor—with the fluorescent lamp connected in parallel with the capacitor. Due to series-resonant action, if the lamp should happen to be non-connected or non-functional, and if proper precautions are not taken, the magnitude of the voltage developed across the capacitor may become so large as to cause damage to the circuit components and/or even to the source.

To prevent such circuit damage, yet providing for a lamp starting voltage of suitably large magnitude and for an adequately long time, a Varistor voltage-limiting means is connected in parallel with the capacitor; and a thermally actuated circuit breaker is connected in thermal contact with the Varistor. When actuated, the circuit breaker stops the series-resonant action.

Under normal circumstances, when starting the fluorescent lamp, the magnitude of the voltage developed across the capacitor will be limited by the Varistor; which, during the brief period it takes for the lamp to ignite, will not become hot enough to cause the circuit breaker to actuate. If the lamp is non-connected or non-functional, however, the Varistor will provide voltage limitation for a longer time; and, after a few seconds, it will become hot enough to cause actuation of the circuit breaker.

Once actuated, the circuit breaker remains actuated until power is removed from the ballast input.

DESCRIPTION OF THE PREFERRED EMBODIMENT

Description of the Drawing

Figure 1:
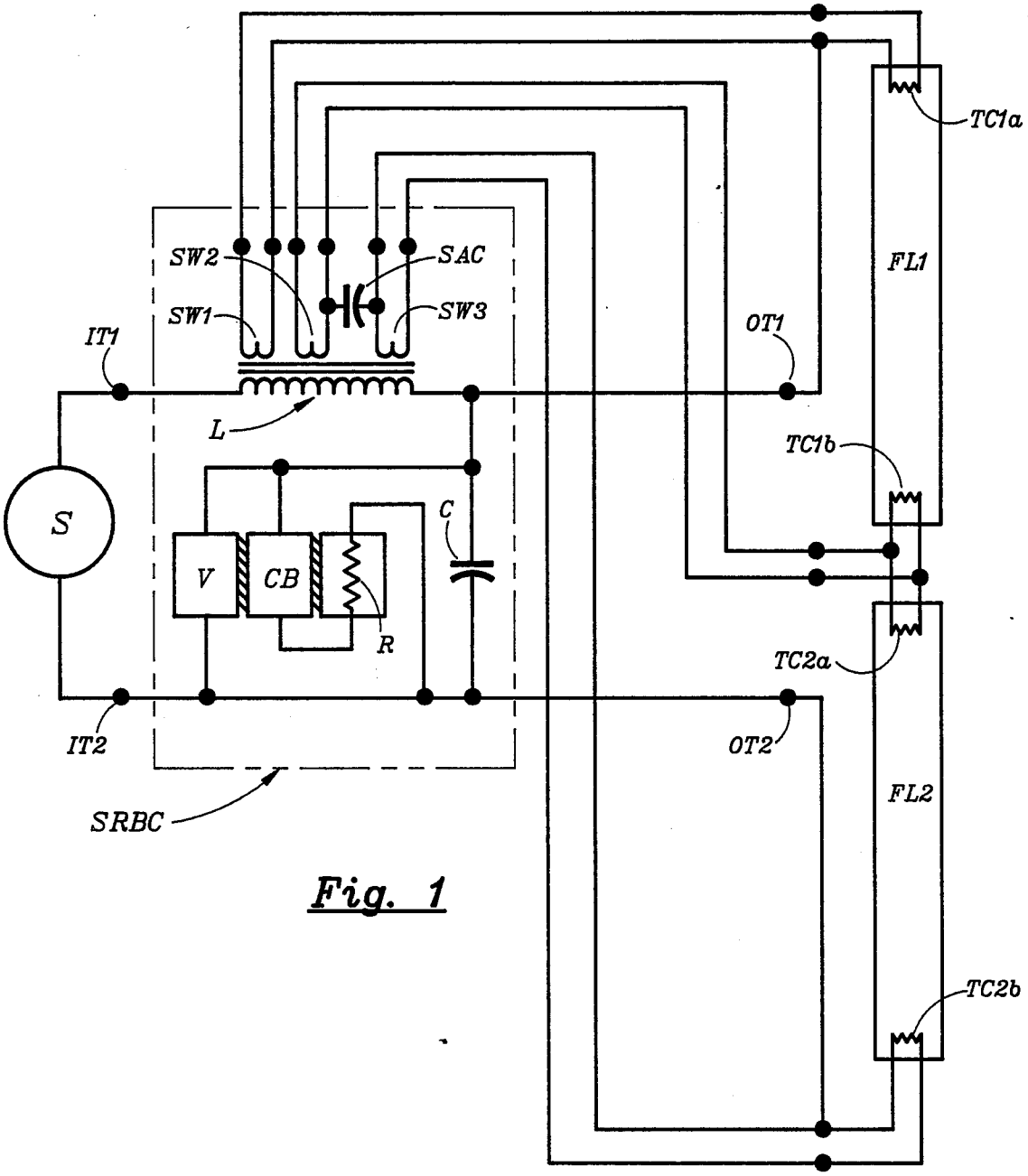
FIG. 1 diaagrammatically illustrates subject series-resonant fluorescent lamp ballast.

FIG. 1 schematically illustrates the complete series-resonant ballast circuit, which in the drawing is referred to as SRBC. The ballast circuit is powered from a source S of substantially square-wave 30 kHz voltage.

Ballast circuit SRBC has two input terminals IT1 and IT2, and two output terminals OT1 and OT2. Connected across input terminals IT1 and IT2 is a series-combination of an inductor L and a capacitor C—with capacitor C being connected across output terminals OT1 and OT2. Input terminal IT2 is connected directly with output terminal OT2.

Connected across C is a Varistor V—a Varistor being a non-linear resistor whose impedance is very high as long as the magnitude of the voltage across it is below a certain lower level; but whose impedance becomes very low as soon as the voltage across it exceeds a certain higher level.

Thermally connected with the Varistor is a thermally responsive circuit breaker or switch means CB. Also thermally connected with CB is a resistor R. CB and R are connected in series, and this series-combination is connected in parallel with the Varistor.

Inductor L has three low-voltage secondary windings SW1, SW2, and SW3. A starting-aid capacitor SAC is connected between windings SW2 and SW3.

A a pair of 40 Watt T-12 Rapid-Start fluorescent lamps FL1 and FL2 are connected in series directly across output terminals OT1 and OT2. These lamps each have a pair of thermionic cathodes TC1*a* and TC1*b* for lamp FL1, and TC2*a* and TC2*b* for lamp FL2. Each cathode has a pair of cathode terminals—with the cathode terminals of cathode TC1*b* being directly connected in parallel with the cathode terminals of cathode TC2*a*.

Secondary winding SW1 is connected with cathode TC1*a;* secondary winding SW2 is connected directly with the parallel-combination of cathodes TC1*b* and TC2*a;* and secondary winding SW3 is directly connected with cathode TC2*b*.

Description of Operation

In FIG. 1, a 30 kHz squarewave voltage of about 160 Volt peak magnitude is provided by source S across input terminals IT1 and IP2. The L and the C are both of relatively high quality (high Q) and are series-resonant at or near 30 kHz. Thus, in the absence of any loading on the L-C circuit, the magnitude of the voltage developing across C will be several times larger than that of the voltage provided across the series-circuit (i.e., across input terminals IT1 and IT2). In fact, with the reasonably achievable circuit Q-factor of 50 and without external loading, the magnitude of the voltage developed across C will be about 50 times larger than that of the voltage impressed across the series-circuit: that is, if the L and the C are capable of handling such large voltage magnitudes.

However, with some form of external loading—such as the Varistor or the fluorescent lamps—the voltage magnitude across C will be limited to a lower level. In particular, before the lamps start or with the lamps disconnected, the magnitude of the voltage developing across C will be limited by the Varistor.

Since the voltage required for properly starting two series-connected rapid-start lamps is about 300 Volt RMS, the Varistor is chosen such as to limit the voltage developing across C to approximately 300 Volt RMS.

The voltage required by the thermionic cathodes to reach and maintain proper emission temperatures is about 3.6 Volt RMS; which therefore is chosen as the voltage provided on a continuous basis by each of the three secondary windings SW1, SW2, and SW3 on inductor L. However, before lamp ignition, the voltage across L will be about 50% higher than it will be after the lamps have started. Thus, during the initial starting process the cathode voltages will be about 5.4 Volt RMS instead of 3.6 Volt RMS; which implies that the cathodes will reach their operating temperature in a substantially shorter time span than normally would be the case.

Normally, with 3.6 Volt RMS on the cathodes, lamp starting will occur within about two seconds. With 5.4 Volt RMS on the cathodes, lamp starting will occur well within one second.

Once the lamps have started, the magnitude of the voltage across C will diminish to the operating voltage of the lamps; which operating voltage is about 200 Volt RMS—i.e., about 100 Volt RMS per lamp.

In a high-Q series-resonant L-C circuit the amount of power drawn by the circuit is roughly proportional to the magnitude of the voltage present across the tank-capacitor (or across the tank-inductor). Thus, since the power drawn by each lamp at the normal lamp operating voltage of 100 Volt RMS is about 40 Watt (for a total of about 80 Watt), the power drawn by the Varistor during the brief period before the lamps start is approximately 120 Watt. Thus, by allowing at least one second for the lamps to start, the implication is that the Varistor has to be able to absorb 120 Watt for that length of time; which results in an accumulated energy dissipation of 120 Joule.

After having absorbed 120 Joule in a timespan of less than one second, the Varistor is quite hot; but not quite hot enough to cause actuation of CB: the thermally actuated circuit breaker to which the Varistor is thermally tightly coupled. However, with about 250 Joule dissipated in the Varistor during a time period of two seconds or so, enough heat is generated to cause actuation of the circuit breaker.

Upon actuation, CB changes from a state of having open contacts to a state of having closed contacts. Thus, after actuation, current will flow through the closed contacts of CB and also through resistor R.

The resistance of R is relatively low since its only purpose is that of generating enough heat to cause CB, once actuated, to remain in its actuated state. To this end, R is thermally tightly coupled with the thermally active part of CB. (The amount of power dissipation required in R is on the order of 1 Watt.)

Once actuated, CB effectively provides for a short circuit across C; which, of course, has the effect of preventing the series-resonant action from taking place. Thus, after actuation of CB, the amount of current flowing into the ballast circuit is simply limited by the reactance of L; and, except for the 1 Watt or so dissipated in R, this current will be substantially non-dissipative.

Once CB is actuated, it will remain in its actuated state until power is removed from the ballast input terminals.

Summary

In other words, the principal component parts and modus operandi of subject series-resonant ballast circuit are as follows.

(a) A high-frequency squarewave voltage is provided to the ballast input terminals.

(b) A series-connected L-C circuit is connected directly across these input terminals; and this L-C circuit is series-resonant at or about the fundamental frequency of said squarewave voltage. Due to the series-resonant action, the magnitude of the voltage developed across the capacitor of the L-C circuit gets to be very high—limited primarily by any loading provided externally of the L-C circuit.

(c) A circuit protection means is connected in parallel with the capacitor. This protection means consists of a Varistor and a normally-open thermally activated latching circuit breaker. The Varistor, which is thermally tightly coupled to the thermally activated part of the circuit breaker, acts as a voltage limiter and prevents the voltage across the capacitor from exceeding a certain preset level. However, to limit power dissipation in and possible destruction of the Varistor, after the temperature of the Varistor has reached a preset level, the circuit breaker actuates and acts to stop the resonant action from taking place, thereby removing the power dissipation from the Varistor and substantially reducing the amount of power drawn by the ballast from the source of squarewave voltage.

(d) A pair of series-connected fluorescent lamps is connected in parallel with the capacitor of the L-C circuit. The magnitude to which the Varistor limits the voltage developed across the capacitor is chosen such as to provide for appropriate lamp starting voltage. However, once the lamps start, the magnitude of the voltage developed across the capacitor will be limited to the operating voltage of the series-connected lamps; which magnitude is substantially lower than that at which the Varistor provides voltage-limitation. Thus, after the lamps have started, current substantially ceases to flow through the Varistor.

Comments

The following items are noted.

(i) The circuit breaker (CB in FIG. 1) could just as well have been placed in series with the ballast power input line; in which case, of course, the circuit breaker would have to have its contactors arranged in a normally-closed fashion.

(ii) For improved lamp operating efficiency (although at the expense of a slight fore-shortening of lamp life), the lamps' cathode voltages may be chosen such that the cathodes get their normal operating voltage of 3.6 Volt RMS only during the starting cycle; which implies that, after the lamps have started, they will only get a voltage of 2.4 Volt RMS. However, as a result, the starting cycle takes longer, and the power dissipation capability of the Varistor would then have to be increased.

(iii) A Zener device may be used instead of the Varistor.

It is believed that the present invention and its several attendant advantages and features will be understood from the preceeding description. However, without departing from the spirit of the invention, changes may be made in its form and in the construction and interrelationships of its component parts, the form herein presented merely representing the preferred embodiment.

I claim:

1. A ballast for a gas discharge lamp, said ballast being adapted to permit operation from a source of non-removable AC voltage and comprising:

a pair of input terminals operable to connect with said source of AC voltage;

a series-circuit of an inductor and a capacitor, said series-circuit being: (i) connected across said pair of input terminals, (ii) naturally resonant at or near the fundamental frequency of said AC voltage, and (iii) disposed to series-resonant action whenever said AC voltage is present across said input terminals;

connect means operable to permit said gas discharge lamp to be connected in parallel-circuit either with said capacitor or with said inductor; whereby, whenever the lamp is thusly connected and operating, said series-circuit is provided with a proper load; and cut-out means connected in circuit with said series-circuit and operative to prevent said series-resonant action from taking place whenever the lamp is not connected or otherwise fails to provide said proper load;

the AC voltage being provided across the input terminals even while the cut-out means is performing its preventive function.

2. The ballast of claim 1 wherein said cut-out means comprises a thermally actuated switch means.

3. The ballast of claim 2 wherein said cut-out means also comprises a non-linear dissipative impedance means.

4. The ballast of claim 1 and a voltage-limiting means connected in parallel-circuit with either the capacitor or the inductor.

5. The ballast of claim 4 wherein said voltage limiting means comprises a Varistor.

6. The ballast of claim 4 wherein said cut-out means is operative, whenever the lamp fails to provide said proper load, to permit said series-resonant action to take place for a brief period of time.

7. The ballast of claim 6 wherein said brief period of time is no longer than about two seconds.

8. The ballast of claim 1 wherein the fundamental frequency of said AC voltage is higher than about 10 kHz.

9. A ballast for a gas discharge lamp, said ballast being adapted to operate from a source of AC voltage and comprising:

a pair of input terminals operable to connect with said source of AC voltage;

a series-circuit of an inductor and a capacitor, said series-circuit being: (i) connected across said pair of input terminals, (ii) naturally resonant at or near the fundamental frequency of said AC voltage, and (iii) disposed to series-resonant action whenever said AC voltage is present across said input terminals;

connect means operable to permit said gas discharge lamp to be connected in parallel-circuit either with said capacitor or with said inductor; whereby, whenever the lamp is thusly connected and operating, said series-circuit is provided with a proper load, thereby preventing said series-circuit from drawing a destructingly large amount of current due to said series-resonant action; and non-linear impedance means connected with said series-circuit and operative to provide said proper load in lieu of the lamp whenever the lamp is not connected or otherwise fails to provide said proper load;

the AC voltage being provided across the input terminals even while the non-linear impedance means is performing its loading function.

10. A non-inverter-type ballast for a gas discharge lamp, said ballast being adapted to operate from a source of AC voltage and comprising:

a pair of input terminals operable to connect with said source of AC voltage;

a series-circuit of an inductor and a capacitor, said series-circuit being: (i) connected across said pair of input terminals, (ii) naturally resonant at or near the fundamental frequency of said AC voltage, and (iii) disposed to series-resonant action whenever said AC voltage is present across said input terminals;

connect means operable to permit said gas discharge lamp to be connected in parallel-circuit either with said capacitor or with said inductor; whereby, whenever the lamp is thusly connected and operating, said series-circuit is provided with a proper load, thereby preventing said series-circuit from developing destructingly large voltages across said capacitor or said inductor due to said series-resonant action; and protection means connected with said series-circuit and operative, whenever said lamp is not connected or otherwise fails to provide said proper load, to prevent said series-circuit from developing said destructively large voltages even with the AC voltage present across the input terminals.

11. In a series-resonant ballasting means for a gas discharge lamp, wherein:

(i) said ballasting means does not comprise inverter means;

(ii) said ballasting means is adapted to operate from a source of AC voltage and comprises an inductor and capacitor connected in series to form a series-resonant circuit;

(iii) said series-resonant circuit is naturally resonant at or near the fundamental frequency of said AC voltage and operable to connect across said source of AC voltage;

(iv) said lamp is connectable in parallel-circuit across said inductor or said capacitor; whereby, when the lamp is connected and operating, said series-resonant circuit is properly loaded; and (v) said series-resonant circuit, when not properly loaded, is disposed to draw an excessively large amount of current from said source of AC voltage, thereby developing destructively large voltages across said capacitor and/or said inductor;

the improvement comprising:

protection means connected with said series-resonant circuit and operative, whenever the lamp is not connected or otherwise fails to cause said series-resonant circuit to be properly loaded, to prevent said series-resonant circuit from drawing said excessively large amount of current from said source of AC voltage as long as said source of AC voltage is present.

12. The improvement of claim 11 wherein said protection means comprises a non-linear voltage-limiting impedance means.

13. The improvement of claim 11 wherein said protection means comprises a cut-out means operative to prevent said series-resonant circuit from exhibiting series-resonant action whenever the lamp is not connected or otherwise fails to cause said series-resonant circuit to be properly loaded.

14. The improvement of claim 13 wherein said cut-out means comprises a thermally activated switch means.

15. The improvement of claim 13 wherein said protection means also comprises a voltage-limiting means.

16. An arrangement comprising:

a source of AC voltage;

an L-C series-circuit: (i) being connected across said source, (ii) being series-resonant at or near the frequency of said AC voltage, and (iii) drawing an excessive amount of power from said source if not being provided with an appropriate load;

lamp means connected with said series-circuit and normally operable to constitute said appropriate load;

protection means connected with said L-C series-circuit and operable, in case the lamp means is removed or otherwise fails to constitute said appropriate load, to prevent said L-C series-circuit from drawing said excessive amount of power from the AC source even while the AC voltage is still being provided across the L-C series-circuit.

17. An operating arrangement for a gas discharge lamp means, comprising:

a source of AC voltage;

an L-C series-circuit: (i) connected across said source, (ii) series-resonant at or near the frequency of said AC voltage, and (iii) disposed to draw an excessive amount of power from said source if not being provided with an appropriate load;

connect means operable to connect said lamp means with said series-circuit, said lamp means being normally operable to constitute said appropriate load when so connected; and protection means connected with said L-C series-circuit and operable, in case the lamp means were to fail to constitute said appropriate load, to prevent said L-C series-circuit from drawing said excessive amount of power even when the AC voltage is still being provided across the L-C series-circuit.

18. In a ballasting means for a gas discharge lamp, said ballasting means: (i) having a pair of input terminals for connection with an AC voltage, (ii) having a series-combination of an inductor and a capacitor, said series-combination being resonant at or near the frequency of said AC voltage and effectively connected across said input terminals, and (iii) having contact means to permit connection of said lamp in effective parallel-circuit with said capacitor; the improvement comprising:

protection means connected in parallel with said capacitor and operative to provide an effective short circuit thereacross in the event that said ballasting means were to be connected with said AC voltage without having said lamp effectively connected in parallel-circuit with said capacitor;

the AC voltage being present across the input terminals even while the protection means is performing its protective function.

19. In a ballasting arrangement for a gas discharge lamp means, said ballasting arrangement having a pair of output terminals representing a source of current for powering said lamp means whenever the lamp is connected thereacross, the improvement comprising:

protection means connected across said pair of output terminals and operative to place an effective short circuit thereacross in the event that said lamp means were to be inoperative or otherwise effectively non-connected with said output terminals;

the protection means performing its protective function even while current is being provided from the output terminals.

20. The arrangement comprising:

gas discharge lamp means requiring for proper operation to be provided at a pair of lamp terminals with an operating current and, when so provided, being operative to limit the magnitude of the voltage resulting between said lamp terminals to a certain magnitude;

a source of current, said source having a pair of source terminals for connection with said lamp terminals and being operable to provide said operating current to said lamp terminals; and protection means connected in parallel with said source terminals, said protection means being responsive to the magnitude of the voltage existing between said source terminals and, in case this magnitude has exceeded a predetermined level for longer than a relatively brief period of time, being operative to place an effective short circuit across said source terminals;

the operating current being provided to said lamp terminals even while the protection means is performing its protective function.

21. The arrangement of claim 20 wherein said predetermined level is substantially larger than said certain magnitude.

22. The arrangement of claim 21 wherein said lamp means requires a lamp starting voltage for initiating said proper operation, and where the magnitude of this starting voltage is about equal to said predetermined level.

23. The arrangement of claim 20 wherein said relatively brief period of time is on the order of one second or less.

24. The arrangement of claim 20 wherein said operating current is of frequency substantially higher than that of the voltage normally present on an ordinary electric utility power line.

* * * * *